United States Patent [19]

Gagnon

[11] Patent Number: 4,560,968

[45] Date of Patent: Dec. 24, 1985

[54] MAGNETIC ACTUATOR FOR A GAS VALVE

[75] Inventor: Ronald W. Gagnon, Cromwell, Conn.

[73] Assignee: United Technologies Corporation, Hartford, Conn.

[21] Appl. No.: 664,630

[22] Filed: Oct. 25, 1984

[51] Int. Cl.[4] ..... H01F 7/08

[52] U.S. Cl. ..... 335/281; 336/192; 251/129.1

[58] Field of Search ..... 335/131, 196, 203, 281, 335/299; 336/192; 251/129

[56] References Cited

U.S. PATENT DOCUMENTS

| | | | |
|---|---|---|---|
| 1,792,621 | 2/1931 | White | 339/102 |
| 2,918,640 | 12/1959 | Higgs | 336/192 |
| 3,998,425 | 12/1976 | Braucksiek | 251/129 |
| 4,341,241 | 7/1982 | Baker | 251/129 X |
| 4,446,449 | 5/1984 | Brown | 335/131 |
| 4,495,480 | 1/1985 | Martin et al. | 336/192 X |

FOREIGN PATENT DOCUMENTS

| | | | |
|---|---|---|---|
| 58532 | 11/1967 | German Democratic Rep. | 335/299 |

*Primary Examiner*—George Harris
*Attorney, Agent, or Firm*—C. G. Nessler

[57] ABSTRACT

The magnetic actuator part of a gas safety valve is constructed with a C-shaped insulator which grips the base portion of a U-shaped magnet that is fastened to a base. The base has welded to it a projecting contact pin. The coil of the electromagnet is fusion welded at both its ends: at its first end it is attached to a plate which connects to the center pin; at its second end it is attached to the contact pin to which it lies transverse. The construction facilitates good electrical connections between dissimilar materials and permits rapid assembly by a robot.

9 Claims, 4 Drawing Figures

FIG. 1
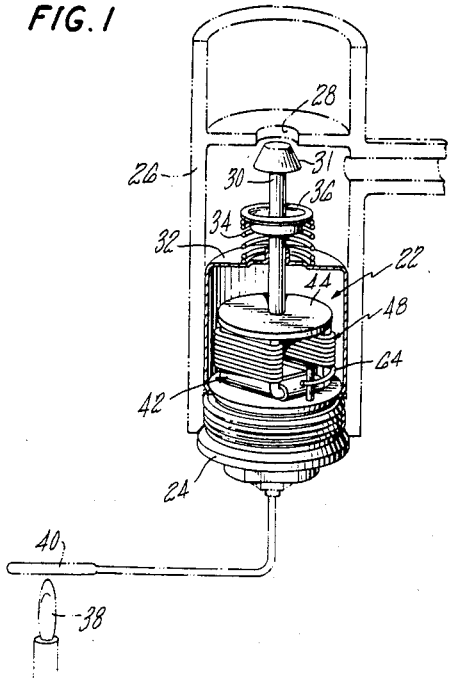
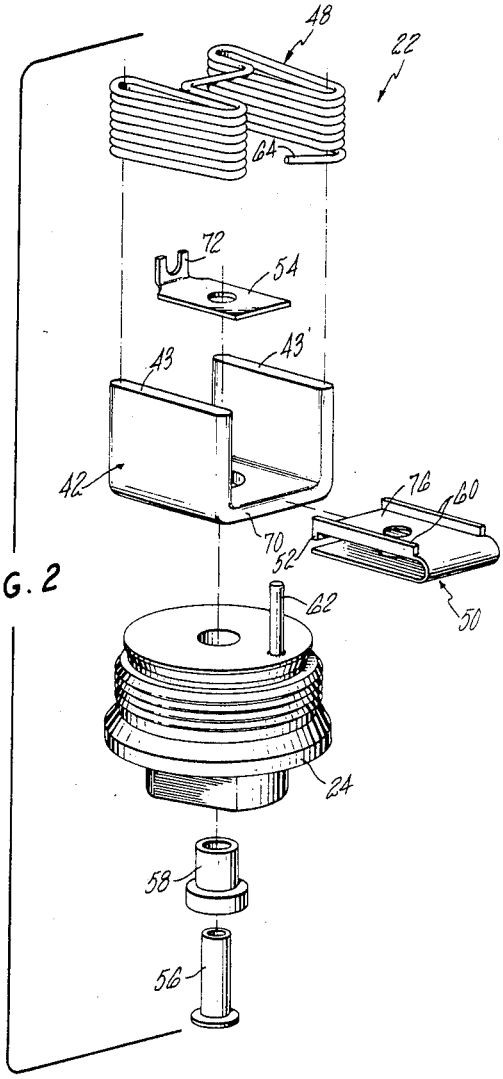
FIG. 2

FIG. 3
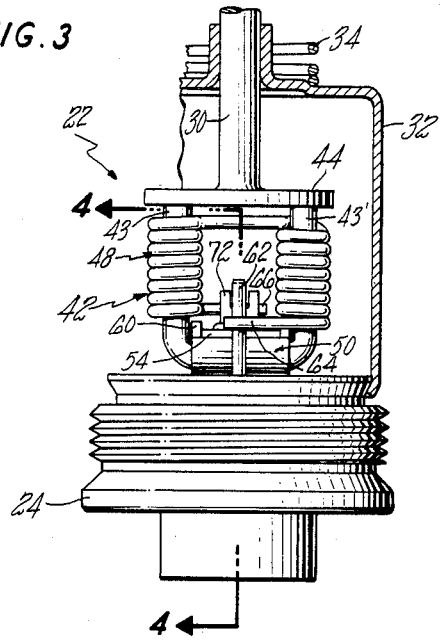
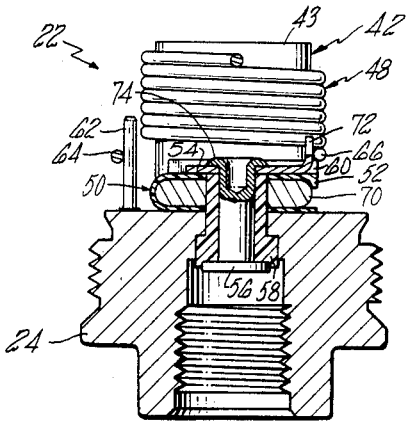
FIG. 4

MAGNETIC ACTUATOR FOR A GAS VALVE

TECHNICAL FIELD

The present invention relates to the construction of the magnetic actuator portion of a gas valve ordinarily used for terminating the flow of gas to an appliance in the event the gas flame is extinguished.

BACKGROUND

In domestic appliances which are powered by methane, propane or other domestic gases, it has been a long recognized practice to provide for the termination of flow of gas in the event that the pilot flame (pilot light) of the appliance is extinguished. As is well known, in such an event there can be excess accumulation of gases and possible explosion, either from gas issuing through the pilot flame orifice or from the main burner.

One of the principal devices in current use which achieves the foregoing objective is a gas valve having a magnetic actuator. U.S. Pat. No. 3,998,425 to Brauck-siek shows a typical device of this sort. The essential operation of such devices is as follows. The sealing part of the valve, adapted to physically terminate the flow of gas from a source, is spring biased toward the closed position. Activation of an electromagnet holds the valve in the open position against the spring biasing force when it is powered by the output of a thermopile or other heat-to-electrical energy conversion device which is placed in the flame. Should the flame be extinguished and thus stop providing a source of heat, the electrical current flow from the thermopile is substantially lowered, thus causing the electromagnet to lose a substantial portion of its force; whereupon, the spring force overcomes the magnetic force and the valve closes. Generally, the valve is reset manually when the flame is rekindled.

As reference to the patent and to the subject matter of the present invention will reveal, such safety valves have a number of parts, not unlike other electromagnetic devices. And since the devices are used in great quantity in domestic appliances for which the market is very competitive, it has always been a desire to make them at a low cost. Of course, the incentive to lower the cost must be balanced against the need for absolute reliability in performing the intended function of the valve, which is to provide for the safety of persons and property.

Safety valves are physically relatively small and heretofore the multiplicity of parts comprising the valve have been manually assembled. The labor involved in assembling an actuator part of the valve is a significant part of the cost of a valve. Of course, the usual attention has been given to the design of the actuator and to tools used by assemblers, in order to lower costs as best possible.

Now, assembly robots have become available and it has been sought to apply such machines to the constuction of a magnetic actuator for a safety valve. An assembly robot is a computer guided machine which is adapted to functionally replicate the acts of human operators in putting diverse components together into a final product. The assembly operation has always been a difficult area, compared to some other areas of using robots, as those in the robotics field know well. In particular, it is presently necessary that the parts be spatially oriented in particular ways and that a variety of dexterous movements be performed. In addition, there are many visual clues received by a human assembler and at the present state of robotic art it is not possible to replicate human visual acuity and response. These limitations were particularly apparent when it was sought to apply an advanced robot (IBM System/1) to the task of assembling a magnetic actuator. For example, the prior art hand-assembled actuator was comprised of small wafer-like insulators and was partially joined together by soldering. Not only were there the problems of orientation, handling and locating of parts, but the soldering operation was inherently time-limiting, in that it required time for both heating and cooling.

When these limitations became apparent, the design and construction of the actuator had to be improved in order to facilitate automation. In doing this, other improvements were also realized as will be apparent from the remainder of this description.

DISCLOSURE OF INVENTION

An object of the invention is to improve the design of gas valves so that they are more adapted to automatic assembly. A further objective is to simplify the design and construction of the magnetic actuator part of gas valves, but to do so in a way which maintains the reliability of performance of such devices.

According to the invention, the magnetic actuator part of a gas valve is comprised of a U-shaped magnet mounted on a body part at its U-base. The electrical coil winding around the U-legs of the magnet is electrically connected at its first end with the body and at the second end with an electrically isolated center pin passing through both the body and the U-base of the magnet. In the invention, there is a C-shaped insulator which embraces the U-base of the magnet, insulating both the face which contacts the base and the opposing face. The insulator has means which retain it on the magnet prior to the magnet being mounted on the base. Preferably, the insulator has a lip on one of its legs which lip engages an edge of the magnet U-base.

In another embodiment of the invention the insulator has a channel shaped cross section to provide stiffness to the leg which has the lip, to better enable retention on the magnet. A plate which lies on the insulator within the channel cross section is fastened to and held in place by the center pin in another aspect of the invention.

In a further embodiment of the invention, the aluminum body has welded to it a copper or aluminum contact pin; and the end of the coil is electrically connected with the base by being welded to the projecting contact pin to which it lies transverse.

Inasmuch as the actuator is configured to permit fusion welding of the resistance or percussive type, the actuator is adapted for rapid assembly. Furthermore, the encompassing of the magnet by the C-shape insulator allows the insulator to be placed on the magnet and be held in place as the magnet is manipulated and fastened onto the base. It is found that the improvements cited will substantially speed the rate at which magnetic actuators can be produced and thus facilitiates efficient output by an industrial robot.

The foregoing and other objects, features and advantages of the present invention will become more apparent from the following description of prefered embodiments and accompanying drawings.

BRIEF DESCRIPTION OF THE DRAWINGS

FIG. 1 shows a magnetically actuated gas safety valve assembly in partial cross section and illustrates how it functions to control the flow of gas through a pipeline according to the presence or absence of a heat source.

FIG. 2 is an exploded view of the magnetic actuator portion of a valve.

FIG. 3 is a side view of the magnetic actuator of FIG. 1.

FIG. 4 is a cross section of the magnetic actuator shown in FIG. 3.

BEST MODE OF CARRYING OUT THE INVENTION

A safety valve of the particular type which is referred to herein is shown in FIG. 1. The valve is comprised of the magnetic actuator part 22 which has a base 24 that screws into the gas pipeline 26 shown in phantom. The pipeline has a small orifice 28 which is opened or closed according to the activation of the valve plunger 30. The valve has a cover 32 which also provides a linear journal for the plunger which is biased in the upward direction by the spring 34 acting on the plunger flange 36. This biasing force can cause upward movement of the plunger, and when it does the seal 31 mounted on the end of the plunger moves into and closes the orifice 28.

The valve is activated, or held in its open position, by virture of the thermal energy emanating from the flame 38 which heats the thermopile 40, both shown in phantom. The thermopile provides electrical energy to the magnetic actuator 22 to cause an electromagnet 42 to hold the magnetic end 44 of the plunger against itself (when the end is brought in proximity by manual re-setting of the valve), resisting the spring bias force. This action is indicated in FIGS. 1 and 3.

The details of the construction of the magnetic actuator part of the valve are shown in FIGS. 2–4. FIG. 2 is an exploded view of the components while FIG. 3 is an elevation view and FIG. 4 is a partial cross section at right angle to the view of FIG. 3.

The exploded view in FIG. 2 shows the various components of the magnetic actuator. There is a base 24 having an upwardly projecting welded-on contact pin 62. The magnet 42 is a U-shaped piece of magnetic iron, the legs 43, 43' of which recieve the compound coil 48 (comprised of two separate turnings, each slipping on a leg). A thermo-plastic insulator 50 slips around the base 70 of the magnet. There is a small tin plated brass plate or tab 54 having a bent up end 72 which rests on top of the insulator when it is in position. The base, insulator, magnet and tab all have holes which align and through which passes the center pin 56 that is inserted from the bottom of the base. The center pin is electrically insulated from the base by means of the flange bushing 58; it is electrically connectable to the plate 54.

The parts are shown in their assembled position in FIGS. 1, 3 and 4. From FIG. 4 it can be seen that the center pin 56 is a rivet which has been flared over at its uppermost end 74 to lock all the components in place, and to enable the center pin to convey the output of one leg of the thermopile to the plate 54. The end 66 of the coil is resistance welded to the bent up end 72 of the plate.

The other end 64 of the coil is welded to the contact pin 62 which is itself welded to the base. The insulator 50 keeps both the plate electrically isolated from the magnet and the magnet electrically isolated from the base. (While it makes automatic assembly more difficult, another embodiment of the invention comprises elimination of the plate 54 and welding of the wire end 66 directly to the center pin 56.)

Referring to FIGS. 2 and 4, the insulator 50 has two features besides its essential C-shape. First, there is a lip 52 which envelops the edge of the magnet 42 when the insulator is pushed into position. The engagement of the parts is maintained by the lip in view of the resilient properties of the insulator; it is preferably made of acetal thermoplastic. Second, the insulator has a channel shaped upper surface, comprised of the vertical flanges 60 and the flat top part 76. The flanges 60 on the one C-leg serve two purposes. First, they receive the plate 54 and keep it electrically isolated by preventing contact with the magnet should there be a tendency toward inadvertent rotation of the tab during assembly or use. Second, the flanges 60 provide structural stiffness to the upper surface 76 of the insulator, thereby making more effective the gripping action of the lip 52.

As noted above, the end 64 of the coil is welded to the pin 62. The base is preferably made of aluminum alloy and the pin is made of copper. The weld joint between the contact pin and the base is carried out by means of percussive welding (contemporaneous resistance heating and compression). This process intensely concentrates the welding energy and is particularly suitable for welding the dissimilar materials of the parts. A weld joint also is made between the bare end 64 of the copper wire of the coil 48 and the pin. To do this, the end 64 is made to lie essentially perpendicular to the contact pin 62. Achieving the joint is thereby made easier inasmuch as there is very concentrated point contact between the two members 64, 62 to be joined. (This is in contrast to the result which ensues in the prior art where the end 64 is simply laid on and welded to the base at the point where the pin projects. When such is attempted it is found that not only is the welding difficult because of the more general contact area, but there is uneven heating of the opposing parts owing to the greater mass and heat sink capacity of the base.) Thus, the feature of the pin 62 is not only that it provides point contact but also that it has a cross sectional area (and mass per unit length) which is similar to that of the copper conductor. In an alternate embodiment of the invention the pin 62 is aluminum instead of copper. In another embodiment the base is brass and the pin is copper. In all instances the weld joint designs allow reliable welds to be achieved, despite the known difficulty of obtaining good joints in dissimilar materials, particularly copper to aluminum weld joints. Of course the invention is applicable to other similar and dissimilar material combinations.

It will perhaps now be appreciated how the C-shaped insulator 50 and pin 62 are advantageous when assembly is by a robot. Previously separate insulators were used on each side of the magnet base. Now, the insulator 50 is able to be slipped onto the magnet prior to its placement on the base. Feeding of the magnet with the insulator thereon to a convenient location for the robot is done without concern that the insulator will be dislodged from its necessary position. Of course, other means than the lip 52 which is shown can be used to retain the insulator on the magnet. These means include other interlocking depressions and protuberances on the base, as well as simple frictional force owing to the resiliency of the C-shape and an initial biasing of the C-shape to be smaller than the magnet base which it encompasses during use. Of course, the more positive mechanical locking embodied by the lip is preferred for the very reason that it is positive.

With respect to the way in which the termini of the coil 48 are electrically connected, it will be noted that the present design facilitates the use of spot and resistance welding in various forms. Such fusion welding is very fast and requires minimal cooling time, thus increasing the output of an automated assembly procedure. Cleanliness, while still important, is made less critical than when soldering is employed. In addition, there are no fluxes to either remove or cause corrosion in the future. In the preferred practice of the invention the flare 74 of the center pin is also resistance welded to the tab. By all these means the reliability of the magnetic actuator is ensured and manufacturing by automatic procedure is faciliated.

Although this invention has been shown and described with respect to a preferred embodiment, it will be understood by those skilled in the art that various changes in form and detail thereof may be made without departing from the spirit and scope of the claimed invention.

I claim:

1. A magnetic actuator for a gas valve comprised of a body; a U-shaped magnet mounted at its U-base on the body; an electrical coil winding around the U-legs of the magnet, electrically connected at a first coil end with the body and at a second coil end with an electrically isolated center pin passing through both the body and the U-base of the magnet; characterized by a C-shaped insulator embracing the U-base of the magnet to insulate both the face of the magnet which contacts the base and the opposing face thereof; and, means which retain the insulator on the magnet prior to its being mounted on the base.

2. The actuator of claim 1 characterized by the insulator having a lip on one leg of the C-shape to engage an edge of the magnet U-base, to thereby provide the means which retain the insulator on the magnet.

3. The actuator of claim 1 characterized by the one C-leg of the insulator having a channel shaped cross section to thereby provide stiffness to the leg and to enable the insultor to better grip and remain placed on the magnet U-base prior to assembly.

4. The actuator of claim 3 characterized by a plate lying upon the insulator within the channel cross section; the plate fastened to and held in place by the center pin; and, the second coil end physically connected to the plate.

5. The actuator of claim 4 characterized by the second coil end being welded to the plate; and, the plate being welded to the center pin.

6. The actuator of claim 1 characterized by a contact pin projecting from the body, and, the first end of the coil crossing transverse to and being welded to the pin.

7. A magnetic actuator for a gas valve comprised of a body; a U-shaped magnet mounted at its U-base on the body, an electrical coil winding around the U-legs of the magnet, electrically connected at a first coil end with the body and at a second coil end with an electrically isolated center pin passing through both the body and the U-base of the magnet; characterized by a contact pin which projects upwardly from the body, the first coil end lying transverse to the contact pin and physically connected thereto.

8. The actuator of claim 7 characterized by a coil winding made of copper wire and a body made of a dissimilar material.

9. The actuator of claim 7 characterized by a contact pin which is percussive welded to the body and a first coil end fusion welded to the contact pin.

* * * * *